United States Patent [19]

Arvisenet et al.

[11] 4,032,823

[45] June 28, 1977

[54] SUPPLY CIRCUIT FOR ELECTROMAGNETS

[75] Inventors: Jacques Arvisenet, La Celle St Cloud; Jean-Pierre Guery, Poissy; Jacques Olifant, Rueil-Malmaison; Christian Thomas, Poissy, all of France

[73] Assignee: La Telemecanique Electrique, France

[22] Filed: Oct. 21, 1975

[21] Appl. No.: 624,514

[30] Foreign Application Priority Data

Oct. 28, 1974 France ..... 74.35952

[52] U.S. Cl. ..... 361/194; 361/159

[51] Int. Cl.[2] ..... H01H 47/04

[58] Field of Search ..... 317/154, 155, 159.5, 317/156, DIG. 4, DIG. 6

[56] References Cited

UNITED STATES PATENTS

| | | | |
|---|---|---|---|
| 1,745,864 | 2/1930 | Pearce | 317/156 R X |
| 2,410,183 | 10/1946 | Ray | 317/155 X |
| 3,202,978 | 8/1965 | Lewis | 317/154 X |
| 3,842,329 | 10/1974 | Mierendorf | 317/154 X |
| 3,943,416 | 3/1976 | Degenhart | 317/154 |

*Primary Examiner*—Harry E. Moose, Jr.

*Attorney, Agent, or Firm*—William Anthony Drucker

[57] ABSTRACT

An improved supply circuit for electromagnets. The supply circuit comprises a bridge rectifier, an attracting winding positioned in the diagonal of the bridge rectifier, a holding winding placed on the magnetic circuit of the electromagnet, and an isolating contact which isolates the bridge at the end of the pulling-in course of the movable member of the magnetic circuit. The holding winding being connected in parallel across the system formed by the isolating contact and the bridge rectifier.

7 Claims, 7 Drawing Figures

SUPPLY CIRCUIT FOR ELECTROMAGNETS

The invention relates to supply circuits for electromagnets.

Circuits are already known which have a main large wire winding dimensioned for supporting most of the pulling-in current and an auxiliary fine wire winding for supplying the ampere turns necessary for holding the armature, whereby each of these windings is put into operation as a function of the armature position via a so-called reduction contact. These circuits require the use of magnetic circuits dimensioned as a function of the type of source (a.c. or d.c.) which does not permit their economic utilisation in all cases. Furthermore, supply circuits for electromagnets are known having a rectifying circuit such as a bridge rectifier permitting the energization of a single winding both from an a.c. source and a d.c. source, whereby a reduction contact in this case permits the reduction of the voltage applied to the bridge rectifier with a view to reducing consumption during holding of the armature.

In these circuits the bridge rectifier is permanently subjected to a relatively high voltage, even during holding, and a by no means negligible quantity of energy is dissipated in a reduction resistor.

The invention proposes to provide a supply circuit of the type having a main winding and an auxiliary winding which can be associated with magnetic circuits dimensioned independently of the type of source, whereby the said circuit has a bridge rectifier which is isolated from the source during holding and which can be used efficiently both with alternating and direct current.

The invention also has for its object electromagnets having the said circuit.

The circuit according to the invention in itself has all the advantages of each of the solutions proposed previously without having the indicated disadvantages.

According to the invention, an electromagnetic supply circuit for an electromagnet comprising in per se known manner a fixed magnetic circuit and a movable magnetic circuit substantially has a first large wire winding called the attracting winding placed in the so-called d.c. diagonal of a bridge rectifier having four arms whose other diagonal is connected to the a.c. or d.c. power source, a second fine wire winding called the holding winding which may or may not be in series with a resistor mounted on the same magnetic circuit as the main winding and connected in parallel on the series connection of the bridge and an isolating contact (switch) whose operation is linked with that of the movable armature of the electromagnet, this contact being closed on putting the electromagnet into operation and opened when the movable armature has arrived close to its operating position.

According to another feature of the invention, a diode is connected in series with the holding winding.

According to yet another feature of the invention, the isolating contact is an electronic contact whose conductive or blocked state is determined by the development of the flux in the magnetic circuit.

This solution is really only of interest for alternating current because the current extinction of a controlled semiconductor causes problems with direct current operation.

The invention will be better understood from reading the following description with reference to the appended drawings, in which.

Figure 3:
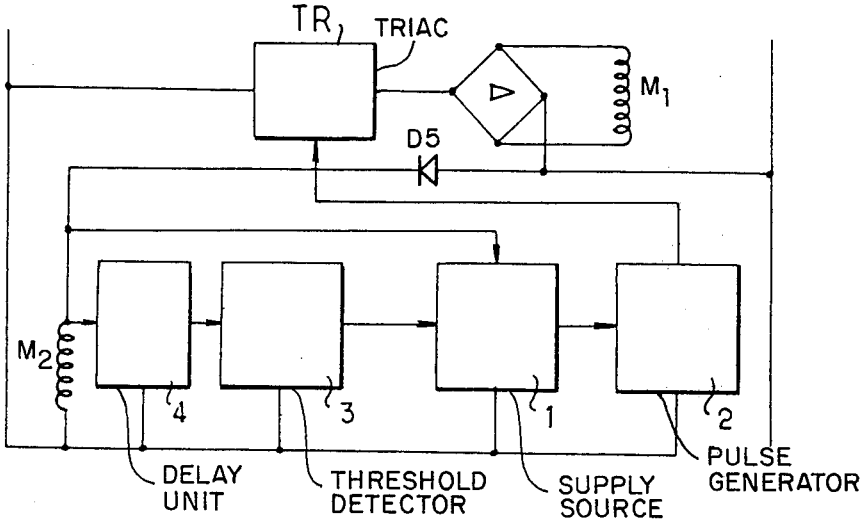
Figure 4:
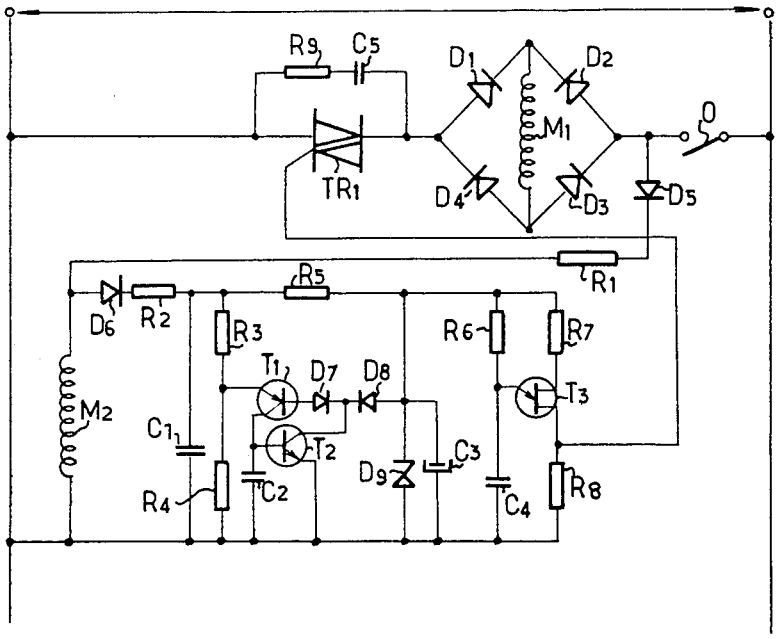
Figure 5:
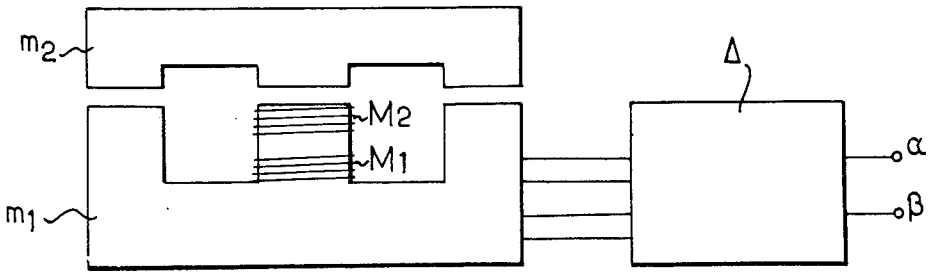
Figure 6:
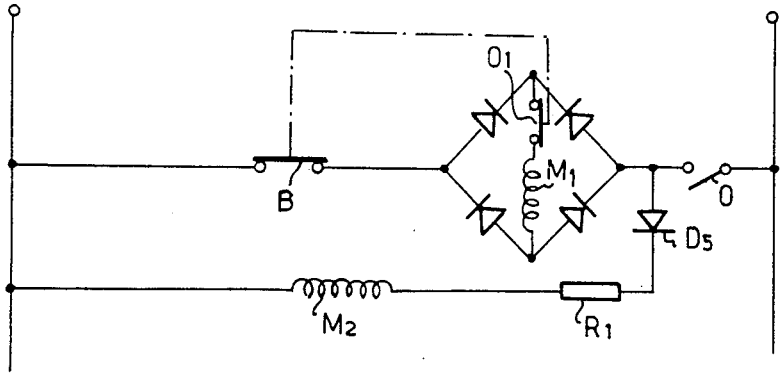
Figure 7:
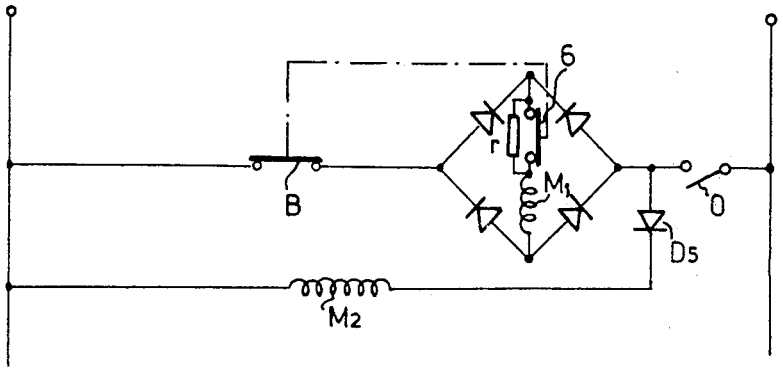

FIG. 3, diagramatically shows another variant, provided with a static switch;

FIG. 4, is a detailed circuit diagram of the embodiment of FIG. 3;

FIG. 5, shows an example of an electromagnet having a supply circuit according to the invention;

FIGS. 6 and 7 illustrate variants of the circuit diagrams of FIGS. 1–4.

Figure 1:
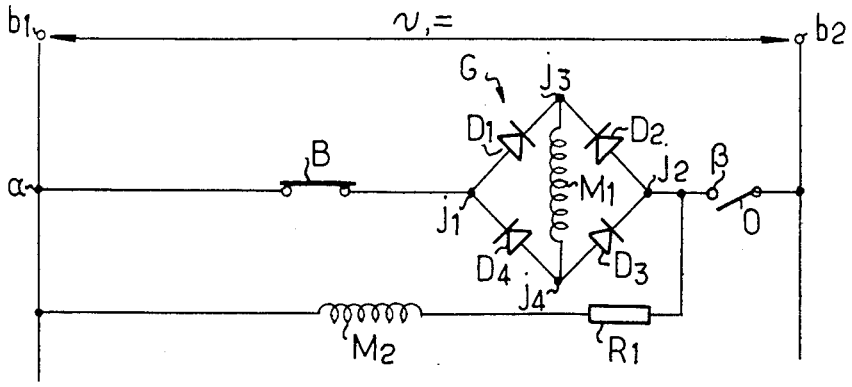
FIG. 1, is a basic diagram of a circuit according to the invention.

The circuit shown in FIG. 1 comprises a large wire magnetic winding M1 placed on the fixed magnetic circuit of an electromagnet, not shown here but shown in FIG. 5 as *m*l, and dimensioned to supply the necessary attractive force. Winding M1 is placed between points *j*3 and *j*4, so-called d.c. terminals of a bridge rectifier G whose four diodes are D1 to D4. The so-called a.c. terminals of the bridge rectifier *j*1 and *j*2 are connected to the a.c. or d.c. terminals *b*1 and *b*2 of the mains on the one hand via the general control contact O of the electromagnet for terminals $j_2$, and on the other vi the isolating contact B which is closed during pulling in and opens when the movable magnetic circuit (*m*2, FIG. 5) terminates or has terminated its course. A second fine wire magnetic winding M2, which may or may not be in series with a resistor R1 is connected between points $\alpha$ and $\beta$ i.e. in parallel across to the system formed by contact B and bridge rectifier G. Resistor R1 can optionally comprise the resistance of winding M2.

These windings can be distributed either as winding halves, for example in the case of U-shaped magnetic circuits or as two windings on the same branch.

In operation of the a.c. circuit will not be considered with reference to FIG. 1.

On energizing the device the main coil M1 is traversed by a significant rectified current making it possible to obtain the elctromagnetic force necessary for the attraction of the movable magnetic circuit. When the attraction course is at an end, isolating contact B has opened and the supply of the diode bridge is no longer assured directly by the mains. The magnetic excitation necessary for holding purposes is then produced by the alternating current travelling in the auxiliary winding and through induction effect in the pulling-in winding. The system formed by the closed magnetic circuit (m1 and m2, FIG. 5) and the two windings actually behaves as a transformer whose primary is the auxiliary winding and whose secondary is the main winding shorting on the diodes of the bridge rectifier in its d.c. arms (diodes D1 to D4). In alternating current operation the magnetic holding force of the circuit is mainly due to the passage of a half-wave rectified current in main winding M1 whose duration is greater than the half-cycle of the mains due to the inductive nature of the circuit. Resistor R1 mounted in series with the auxiliary winding (optionally represented by the resistance of the said winding) is dimensioned to adjust the energy transmitted to the main winding when the latter is used as the transformer secondary.

This circuit can be supplied with direct current. Then, the main winding is not involved in the production of the holding force which is solely created by winding M2.

Figure 2:
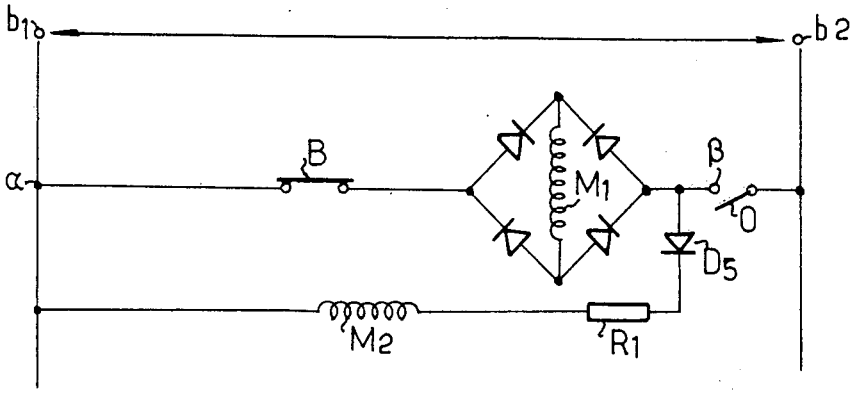
FIG. 2, shows a variant of the circuit of FIG. 1.

FIG. 2 shows an improvement of the basic device, in which a diode D5 arranged in series in the auxiliary circuit imposes a unidirectional passage of the current in winding M2. When the electromagnet is in the holding position energizing ampere turns are generated by the half-wave rectified current passing in the auxiliary winding M2. Furthermore, as the transformer effect still exists the alternating component of the primary rectified current induces a second current which, as hereinbefore, is rectified in half-wave manner. Moreover, the alternating component induced in the main winding is in phase opposition with the auxiliary winding component. Thus, the current in one of these windings appears during the periods when the current is zero in the other. Whilst respecting the winding directions and the diode polarities, additive ampere turns are obtained and the resulting unidirectional flux has a D-C component. Consequently there is a gain over the magnetic excitation during holding relative to the previous diagram in the case of usage with an a.c. supply.

The isolating contact B can be of any known type, for example with mechanical or static commutation or semi-conductor with a controlled conduction capacity. It can be open or closed when the circuit is not energized (stop-go switch O open), the essential feature being that as soon as the circuit is put into operation it closes during the pulling-in period and opens at the time when the travel of the movable armature is substantially terminated.

If the circuit is intended for a.c. operation, the isolating switch can comprise a triac TR, and a firing circuit is then associated therewith as shown in the block diagram of FIG. 3 where the firing circuit comprises the stabilised supply system 1 and the pulse generator 2. As a variant the stabilised supply can be controlled as a function of the movable armature position. More advantageously and as shown on the diagram, the auxiliary winding M2 is used as a sensing element for the position of the movable magnetic circuit, and the indicator phenomenon used is the large over-voltage occurring in this winding on closing the circuit and which is detected 3 by a bi-stable threshold detector connected to the terminals of winding M2. When excited this detector blocks the stabilised supply 1 which, when the stop-go contact O is closed supplies pulse generator 2, the latter ensuring the conduction of triac TR. When the detector threshold is exceeded generator 2 is no longer excited and the triac isolates the bridge rectifier from the power supply.

To ensure the triac TR does not interrupt the power supply to the pulling-in winding too soon, a time delay element 4 is inserted upstream of the detector and at the terminals of the auxiliary winding.

FIG. 4 shows a non-limitative example of the preferred circuit arrangement corresponding to this block diagram. Operation takes place as follows:

On energizing by means of contact O the stabilised supply 1 comprising Zener diode D9 and capacitor C3 is supplied by resistor R5 and permits the recurrent pulse generator 2 constituted by unijunction transistor t3, capacitor c4 and resistors R6, R7 and R8 to fire the gate of triac TR1 which becomes conductive, the pulling-in winding then being excited. At the end of the attraction course the closing of the magnetic circuit causes a characteristic high amplitude over-voltage at the terminals of auxiliary winding M2, and after passage in the time delay element R2-C1 this over-voltage is detected by diode D6 and a threshold bi-stable element constituted by transistors T1, T2, diodes D7, D8, resistors R3, R4 and capacitor C2. The switching of the bi-stable element has the effect of short-circuiting Zener diode D9 via transistor T2 and diode D8. As the unijunction transistor T3 is no longer energized, it no longer emits a firing pulse to the gate of triac TR1 which is blocked at the moment of zeroing of the alternation of the current. Thus the operation of the holding system becomes the same as that of the circuits of FIG. 2. Resistor R9 and capacitor C5 serve to protect the triac.

Although in principle there is no objection to the use of a d.c. electronic switch, this solution has not been adopted in practice due to the difficulties of current extinction of the controlled semi-conductor.

A mechanical isolating contact can on the other hand be used without modification with both a.c. and d.c. supply. Moreover, it has the by no means insignificant advantage of providing the galvanic isolation of the bridge from the mains The supply circuits according to the invention can be used in conjunction with various magnetic circuits of known electromagnets. For reference purposes, FIG. 5 shows the use of such a circuit in the case of conventional magnetic circuits with three branches. In FIG. 5, m1 and m2 respectively designate the fixed magnetic circuit and the movable magnetic circuit (movable armature), and the other reference numerals have the same meanings as hereinbefore. Bridge G, contact B, diode D5 and resistor R1 are placed in a box $\Delta$ having connecting terminals $\alpha$ and $\beta$ (cf. FIG. 1).

The maximum holding current is of the order of a few thousandths of the pulling-in current, i.e. 2 to 20% of the holding current for the circuits. Circuit $m1$ and $m2$ are also much smaler than for conventional electromagnet of the same capacity operating in a.c.

A further advantage of the circuit according to the invention is that the release time of the movable armature is much longer than in the case of conventional circuits (ot the order of 150 ms compared with 50 ms), due to the fact that on interruption the current continues to flow into the system of diodes and resistors which prevents undesired releases of the armature and spurious interruptions of the mains voltage.

If, however, for certain utilisations this time lag is prohibitive (e.g. protection relays) it can easily be brought within the conventional limits by adding a second contact D in series with the primary winding as indicated at 01 in FIG. 6. Contact D would then be connected to contact B, this connection being symbolically designated by the dotted line.

Another interesting possibility for limiting the release time consists of introducing a third contact 6 into the branch where the pulling-in winding is provided as shown in FIG. 7. Contact 6 is shunted by a resistor r which has the advantage of avoiding the fitting of resistor R1 in the transformer primary constituted by M1 and M2 whilst still permitting the selection of the necessary ampere turns for holding the movable armature.

The invention is not limited to the embodiments described and represented which have only been given as examples.

I claim:

1. In an electromagnet structure: a magnetic circuit including a stationary magnetic member and a further magnetic member which is movable to an attracted position with respect to the stationary magnetic member; an attracting coil associated with said magnetic circuit for moving said further member to its attracted position when the attracting coil is energized; a holding coil associated with said magnetic circuit for maintaining said further member in its attracted position when the holding coil is energized; bridge rectifier means for converting AC voltage from a source to DC voltage and applying the DC voltage across said attracting coil, said bridge rectifier means comprising first, second, third and fourth diodes, the catodes of the first and second diodes being electrically coupled to one end of the attracting coil and the anodes of the third and fourth diodes being electrically coupled to the other end of said attracting coil; switching means connecting one terminal of the voltage source to the anode of the first diode and to the cathode of the third diode, the anode of the second diode and the cathode of the third diode being connected to the other terminal of the voltage source; the said switching means being in the open state when the said further member is in its attracted position, one end of the holding coil being electrically coupled to the said one terminal of the voltage source and means connecting the other end of the holding coil to the anode of the second diode and the cathode of the third diode.

2. An electromagnet structure according to claim 1, wherein the said connecting means include a half-wave rectifier element.

3. an electromagnet structure according to claim 2, wherein the said connecting means comprise a resistor in series with the half-wave rectifier element.

4. An electromagnet structure according to claim 1, wherein the said switching means comprise semiconductor element with a controlled conduction capacity and control means for the said semiconductor element which are sensitive to the over-voltage occurring in the holding coil when the said further means reaches it attracted position.

5. An electromagnet structure according to claim 4, wherein the said semiconductor element is a triac having an excitation circuit, the said control means comprising delay means connected across the holding coil, and a threshold detector connected to the said delay means to the said excitation circuit.

6. An electromagnet structure according to claim 1, further comprising further switching means conncted in series with the attracting coil and operated synchronously with the said switching means.

7. An electromagnet structure according to claim 1, further comprising in series with the attracting coil, further switching means and a resistor connected across said further switching means, the said further switching means being operated synchronously with the said switching means.

* * * * *